US009717291B2

(12) United States Patent
Espili et al.

(10) Patent No.: US 9,717,291 B2
(45) Date of Patent: Aug. 1, 2017

(54) VENTED COVERALLS

(75) Inventors: Mehriar Kaviani Espili, Sugar Land, TX (US); Alan Habash, Katy, TX (US)

(73) Assignee: SITCO ENTERPRISES, LLC, Sugarland, TX (US)

( * ) Notice: Subject to any disclaimer, the term of this patent is extended or adjusted under 35 U.S.C. 154(b) by 0 days.

(21) Appl. No.: 13/282,622

(22) Filed: Oct. 27, 2011

(65) Prior Publication Data

US 2012/0210499 A1 Aug. 23, 2012

(51) Int. Cl.

| | |
|---|---|
| ***G21F 3/02*** | (2006.01) |
| ***A41D 13/02*** | (2006.01) |
| ***A41D 27/28*** | (2006.01) |

(52) U.S. Cl.

CPC ..... *A41D 13/02* (2013.01); *A41D 27/28* (2013.01)

(58) Field of Classification Search

CPC ..... A41D 13/018; A62B 17/006; B64D 10/00

USPC ... 2/2.14, 69, 79, 81, 85, 87, 93, 94, 96, 97, 2/100, 269, 456, DIG. 1, DIG. 4

See application file for complete search history.

(56) References Cited

U.S. PATENT DOCUMENTS

| | | | | |
|---|---|---|---|---|
| 2,458,004 | A * | 1/1949 | Kerr | 2/93 |
| 3,045,243 | A * | 7/1962 | Lash et al. | 2/1 |
| 3,086,215 | A * | 4/1963 | Di Paola | 2/93 |
| 3,761,962 | A * | 10/1973 | Myers | 2/79 |
| 3,921,224 | A * | 11/1975 | Ingram, III | 2/93 |
| 4,722,099 | A * | 2/1988 | Kratz | 2/79 |
| 5,642,526 | A * | 7/1997 | Thompson | 2/79 |
| 5,727,256 | A * | 3/1998 | Rudman | 2/115 |
| 6,868,557 | B1 * | 3/2005 | van der Sleesen | 2/93 |
| 7,171,695 | B2 * | 2/2007 | Braun | 2/93 |
| 7,971,283 | B2 | 7/2011 | Winterhalter et al. | |
| 2007/0094763 | A1 * | 5/2007 | Silver | A41D 13/00 2/69 |
| 2007/0245443 | A1 * | 10/2007 | Vereen | 2/69 |

OTHER PUBLICATIONS http://www.riversidehardware.co.uk/Workwear.html.
http://www.amazon.com/Aqua-Design-Camo-Fishing-Shirt/dp/B000FTE0D4.

* cited by examiner

*Primary Examiner* — Sally Haden

(57) ABSTRACT

A vented coveralls is disclosed. Said vented coveralls comprising a bottom portion and a top portion. Said bottom portion having two legs and a top portion having two sleeves. Said top portion having a front, a back, a first side, a second side and one or more vents. Said vents are capable of allowing an air flow to pass through said vented coveralls. Said bottom portion comprises a trouser portion and said top portion comprises a shirt portion of said vented coveralls.

1 Claim, 9 Drawing Sheets

VENTED COVERALLS

BACKGROUND

This disclosure relates generally to vented coveralls.

Coveralls, or "boilersuits", are a one-piece garment with full-length sleeves and legs like a jumpsuit, but usually less tight fitting. In one embodiment, coveralls are called boilersuits are so called because they were first worn by men maintaining coal-fired boilers. Coveralls are a type of overalls. According to the Oxford English Dictionary the term "overalls" (as a garment) was first introduced in 1792. As opposed to overalls, coveralls include full length sleeves. Further, coveralls often comprise a one-piece garment with full-length sleeves and legs like a jumpsuit, but usually less tight-fitting. Coveralls generally have no gap between jacket and trousers or between lapels, and no loose jacket tails.

Coveralls are in common use and are well known to workmen and employees in many fields. Coveralls are most often worn as protective clothing over "street" clothes at work, but sometimes instead of ordinary jacket and trousers. Coveralls are sometimes worn by students as a uniform, French police, and by US Navy, Army and Marine personnel.

In one embodiment, coveralls can be constructed of flame resistant materials. More form fitting coveralls with many zippered pockets, originally made of cotton treated for flame resistance, but made of NOMEX® since the late 1960s, have been used as flight suits since the beginning of WWII. Use of flame resistant or flame retardant (known generally as "FR") materials is important for protection of workers in high risk industries. For example, in one embodiment, coveralls with FR properties are used by employees working on offshore oil production facilities due to the risk of fire at those facilities. Accordingly, an employee wearing said coveralls is more prepared in the event of a fire near his person and garment.

Coveralls with FR properties are, however, very stuffy for parties wearing them. Due to their FR properties the garments worn are typically made of fabrics having more weight than typical (non-FR) work wear. Since said coveralls are often worn by industrial, utility, petrochemical, refinery, drilling, and midstream workers (for example), heat stress is of great concern to the wearer and/or employer. Further, because regulations often require the use of FR garments (such as NFPA 70E, NFPA 2112, and/or OSHA 1910.269), FR garments are often forced on unhappy employees.

Since most parties wearing FR coveralls are required to have on long sleeves and long pants made of heavy non-breathable fabrics, there is a need to develop a method and system to reduce the risk of heat stress and allow air circulation without compromising the FR properties of said coveralls.

Ventilated garments are well known for recreational fishermen in the form of a vented fishing shirt. Said vented fishing shirts comprise light waterproof material capable of providing protection from the natural elements but also comprising a vent stretching across the back and below the shoulder blades of the user. These garments are, nonetheless, incapable of protecting users where FR properties are required. First, said vented fishing shirts are not available as a coverall. Next, they are made of materials that are not known for FR qualities. Also, aside from a vent in a back portion of said vented fishing shirts, they do not provide ample ventilation for users in a high heat FR environment.

These and other distinctions will become apparent to a party knowing the state of the art and having the benefit of the following disclosure.

U.S. patent application Ser. No. 11/401,617, filed by Mr. Vereen, discloses a flame resistant shirt that has a standard front half, but a back half which includes a cape portion with openings to provide ventilation across the wearer's back. Vereen, however, does not disclose a complete coverall and therefore is not eligible for use in many regulated environments where coveralls are required. Further, by disclosing only a shirt, Vereen is more dangerous to wearers since there are additional opportunities for a belt, beltline, shirttails, or similar to hang up when a user is working in a tight location. Further, Vereen does not accommodate multiple ventilation locations and therefore is limited where it comes to reducing heat stress on wearers.

None of the above inventions and patents, taken either singularly or in combination, is seen to describe the instant disclosure as claimed. Accordingly, improved vented coveralls would be advantageous.

SUMMARY

A vented coveralls is disclosed. In one embodiment, a vented coveralls comprising a bottom portion and a top portion. Said bottom portion having two legs and a top portion having two sleeves. Said top portion having a front, a back, a first side, a second side and one or more vents. Said vents are capable of allowing an air flow to pass through said vented coveralls. Said bottom portion comprises a trouser portion and said top portion comprises a shirt portion of said vented coveralls.

In another embodiment, a vented coveralls comprising a bottom portion having two legs and a top portion having two sleeves. Said vents comprise a first side vent, a second side vent, and a back vent. Said top portion having a front, a back, a first side, a second side and a plurality of vents. Said bottom portion comprises a trouser portion of said vented coveralls. Said top portion comprises a shirt portion of said vented coveralls. Said vents comprise a plurality of apertures capable of allowing an air flow to pass through said vented coveralls. Said vents comprise one or more air intakes and one or more air out vents. Said first side vent is under a first sleeve of said top portion. Said second side vent is under a second sleeve of said top portion. Said back vent is on said back of said top portion extending from said first side to said second side. Said back vent comprises a vented layer covered by a flap. Said flap attaches at a top portion of said back vent with a flap stitch.

In yet another embodiment, a vented coveralls is disclosed comprising a bottom portion having two legs and a top portion having two sleeves. Said vents comprise a first side vent, a second side vent, and a back vent. Said top portion having a front, a back, a first side, a second side and a plurality of vents. Said bottom portion comprises a trouser portion of said vented coveralls. Said top portion comprises a shirt portion of said vented coveralls. A portion of said vented coveralls comprise an FR material capable of inhibiting flammability. Said vents comprise one or more air intakes and one or more air out vents. Said vents comprise a plurality of apertures capable of allowing an air flow to pass through said vented coveralls. Said first side vent is under a first sleeve of said top portion. Said second side vent is under a second sleeve of said top portion. Said back vent is on said back of said top portion extending from said first side to said second side. Said back vent comprises a vented layer covered by a flap. Said flap attaches at a top portion of said back vent with a flap stitch.

DETAILED DESCRIPTION

Described herein is a vented coveralls system and method. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
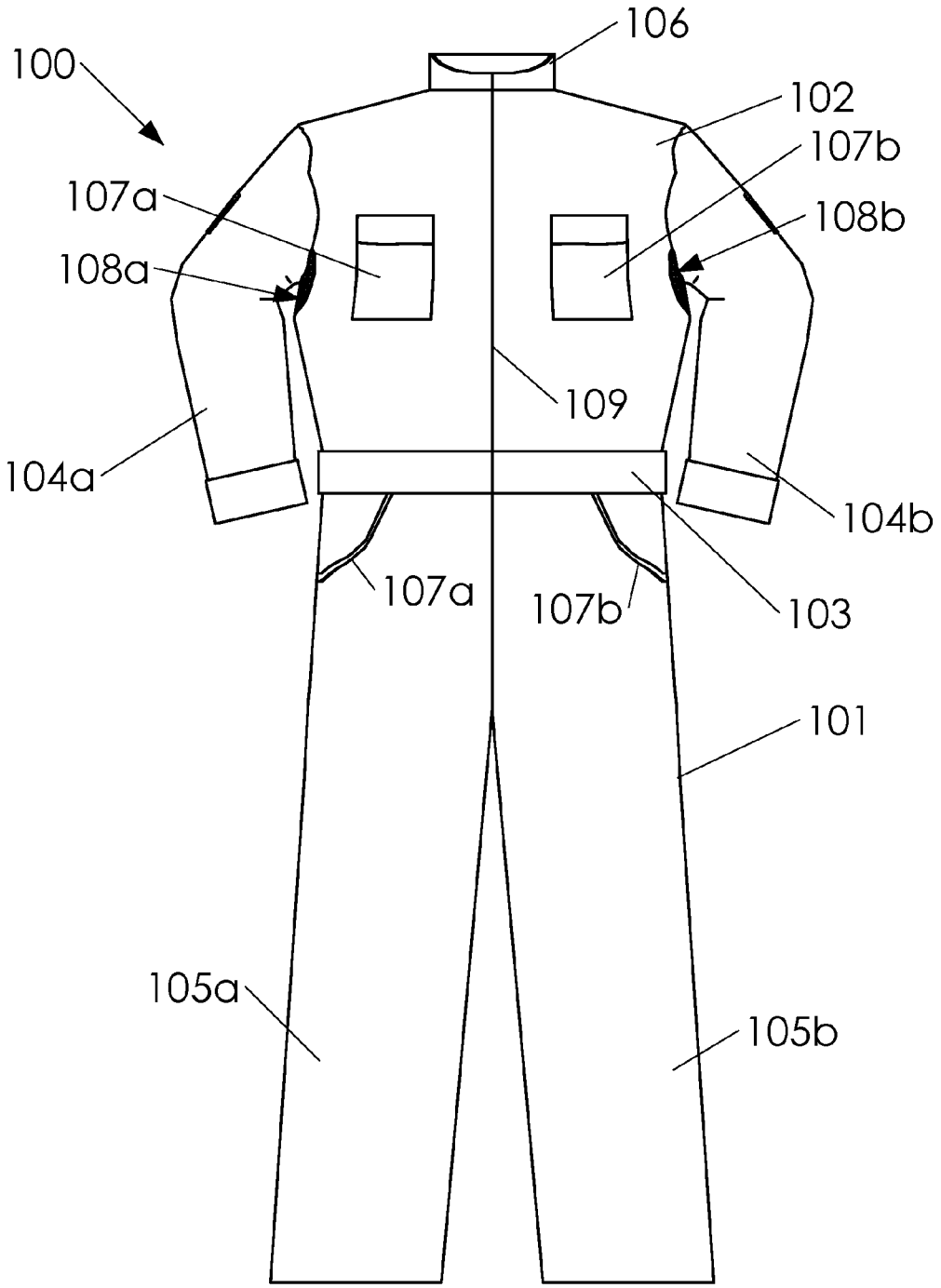
FIG. 1A illustrates a front view of a vented coveralls.

FIG. 1A illustrates a front view of a vented coveralls 100. In one embodiment, vented coveralls 100 can comprise a bottom portion 101, a top portion 102, a waist 103, two sleeves 104, two legs 105, a collar 106, one or more pockets 107, one or more vents 108, and a zipper 109. In one embodiment, top portion 102 can comprise pockets 107, sleeves 104, collar 106, and a portion of zipper 109. In one embodiment, top portion 102 connects to bottom portion 101 with waist 103. In one embodiment, zipper 109 can run from collar 106 down to bottom portion 101. In one embodiment, zipper 109 can open vented coveralls 100 and allow users of vented coveralls 100 to open and wear vented coveralls 100, as is well known. In one embodiment, waist 103 can comprise elastic capable of holding waist 103 in toward a user's body. In one embodiment, bottom portion 101 can comprise a first leg 105*a*, a second leg 105*b*, a first pocket 107*a*, and a second pocket 107*b*.

In one embodiment, vented coveralls 100 can comprise no gap between bottom portion 101 and top portion 102. In one embodiment, bottom portion 101 can comprise a trouser portion. In one embodiment, top portion 102 can comprise a shirt portion. In one embodiment, vented coveralls 100 can comprise a long thin pocket down an outside portion of one of legs 105 capable of hold long tools. In one embodiment, zipper 109 can comprise a front fastening extending the whole length of a front portion of the body up to the throat, with no lapels. In one embodiment, zipper 109 may be fastened with buttons, a zipper, hook-and-loop fasteners, or snap fasteners. In one embodiment, vented coveralls 100 can comprise an attached hood. In one embodiment, vented coveralls 100 can comprise a disposable garment. In one embodiment, vented coveralls 100 can comprise reflectors capable of reflecting light to further protect wearers when in low light conditions (or similar).

In one embodiment, vented coveralls 100 can comprise a fire retardant material, fire resistant material or both. Distinctions on fire resistant and fire retardant are discussed infra, but it is common practice in the art to refer to them together as "FR" materials. Accordingly, vented coveralls 100 can comprise an FR material. One well known example is Nomex®, but other means of building a garment with FR properties are known and commonly practiced in the art.

Said FR materials are also known as fire resistant, fire retardant, flame resistant, and/or flame retardant. A distinction can be made between the terms retardant and resistant, but these terms are often treated as synonymous since most users of said FR materials are concerned with finding a garment which inhibits flammability. Nonetheless, a material that is inherently slow to burn is said to be flame resistant; whereas, a material treated to inhibit flammability is said to be flame retardant. In the context of this disclosure, fire retardant fabrics are textiles that are naturally more resistant to fire than others through chemical treatment or manufactured fireproof fibers. The term fire retardant as applied to organic (i.e., containing carbon) materials, is intended to refer to reduced fire hazard, as all materials will burn under certain circumstances. In one embodiment, a material is said to be said FR material where it reduces fire hazard to meet a regulatory standard limiting flammability regarding recused risk of flammability. In one embodiment, said regulatory standard limiting flammability can comprise NFPA 70E, NFPA 2112, and/or OSHA 1910.269. For example, in one embodiment, a regulation is specified in building codes, such as NFPA 701, and can be more correctly thought of as flame resistance tests, which test a fabric's ability to resist ignition with the flame size and duration in the test conditions. The result is a comparative test, which provides a measure of the material's resistance to propagating combustion caused by small scale ignition sources. These tests do not predict the burning characteristics of full scale hazards. In many cases, if exposed to a sufficiently large and sustained exposure fire, the fire retardant fabrics will burn vigorously.

In one embodiment, a portion of vented coveralls 100 can comprise said FR material. In one embodiment, vented coveralls 100 can comprise an outer portion 114 comprising a top layer our outside surface of vented coveralls 100. In one embodiment, outer portion 114 can comprise bottom portion 101, sleeves 104, front 201 of top portion 102, cover layer 212, first side vent 108*a* and second side vent 108*b*. In one embodiment, outer portion 114 can comprise said FR material. In another embodiment, all of vented coveralls 100 can comprise said FR material. In one embodiment, vented coveralls 100 can comprise none of said FR material and still function for its intended and unintended goals alike.

Figure 1B:
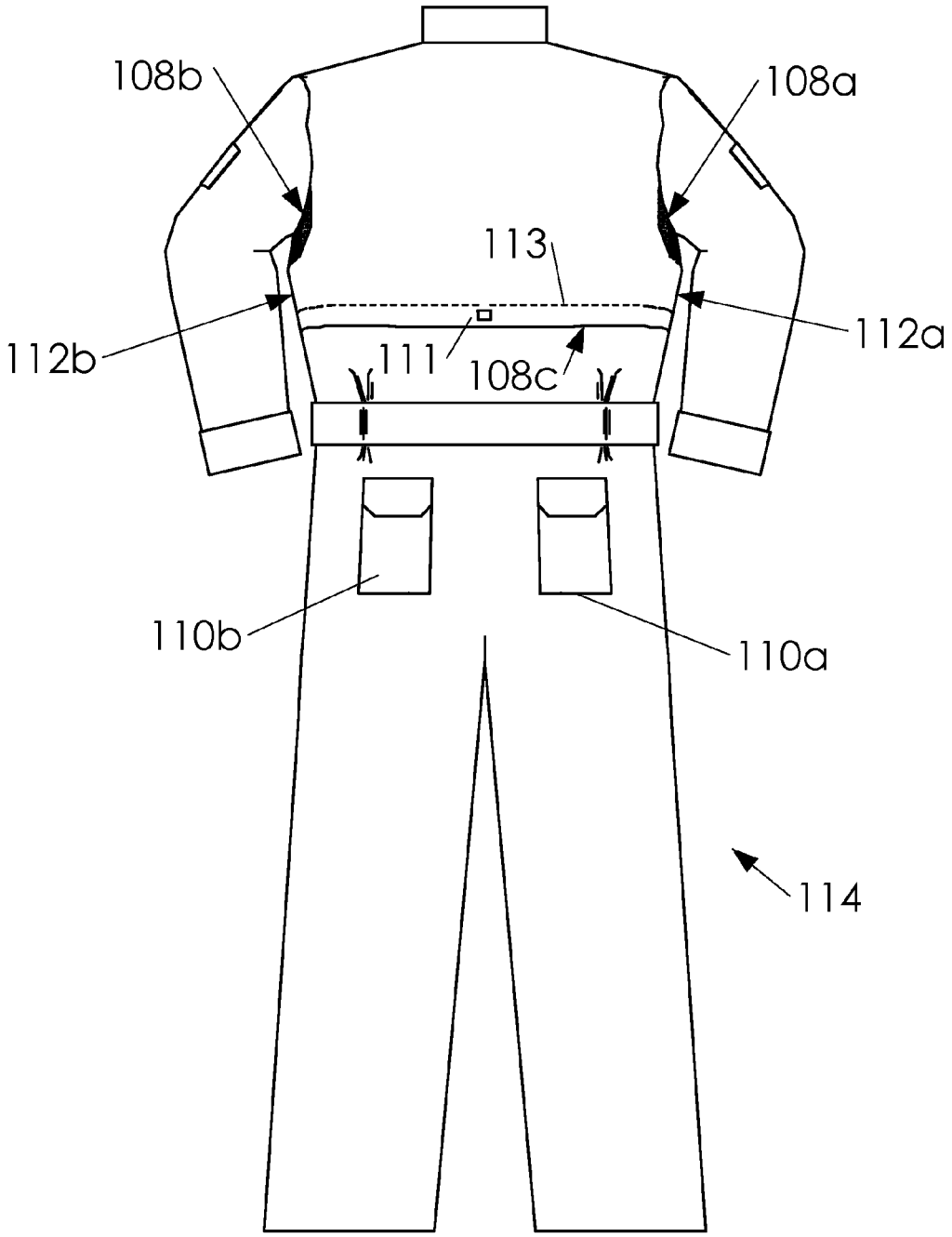
FIG. 1B illustrates a front view of vented coveralls.

FIG. 1B illustrates a front view of vented coveralls 100. In one embodiment, top portion 102 can comprise one or more seat pockets 110 and a flap 111. In one embodiment, vents 108 can comprise a panel between sleeves 104 and top portion 102. In one embodiment, vents 108 can be capable of ventilating said vented coveralls 100 (described infra). In one embodiment, flap 111 can attach to top portion 102 with a flap stitch 113 extending from first side 112*a* to second side 112*b*. In one embodiment, vents 108 can comprise a back vent 108*c*. In one embodiment, back vent 108*c* can be partially covered by flap 111. In one embodiment, back vent 108*c* can be releasably covered by flap 111.

Figure 2A:
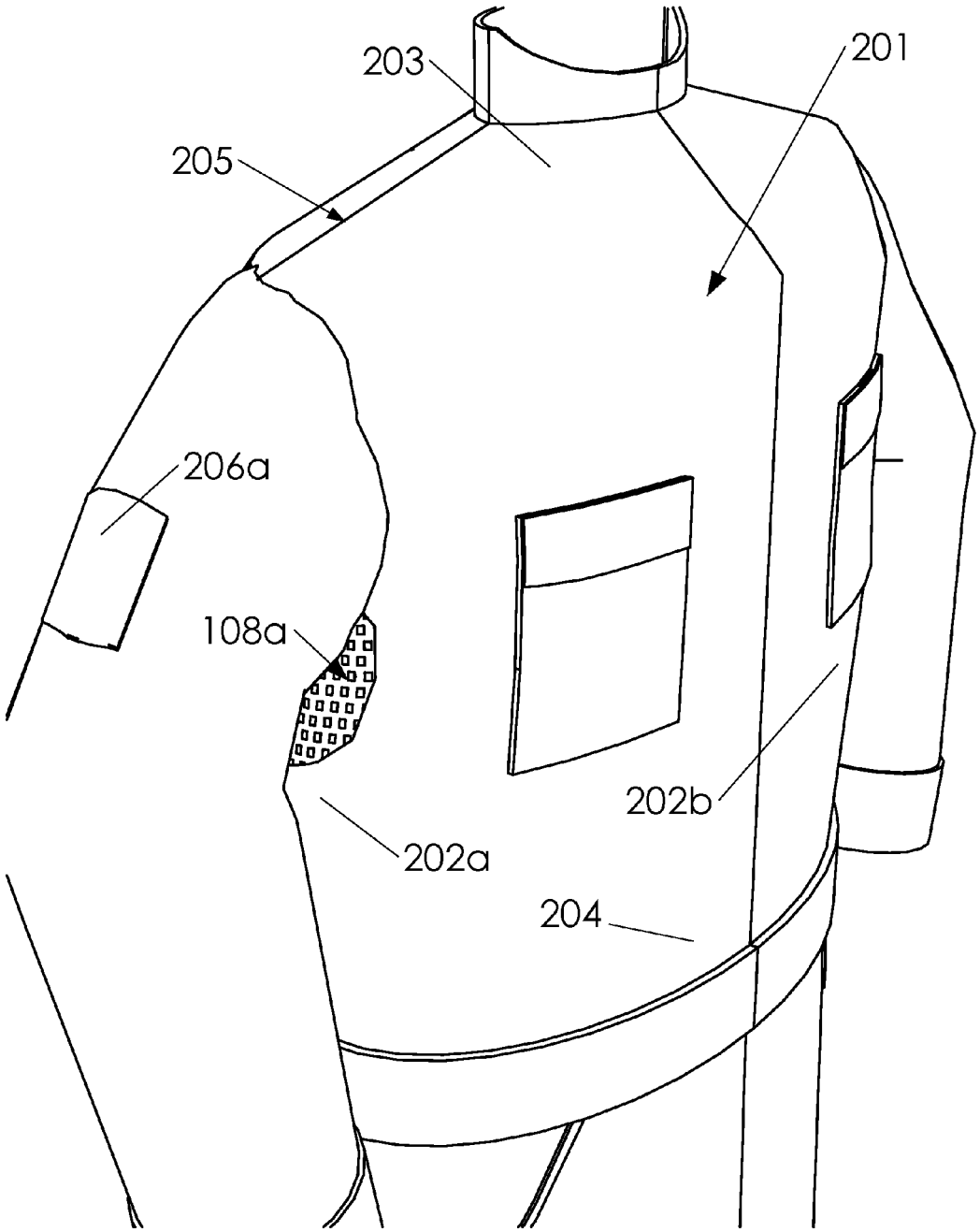
FIG. 2A illustrates a front side overview of vented coveralls.

FIG. 2A illustrates a front side overview of vented coveralls 100. Top portion 102 can comprise a front 201 having a first side 202*a*, second side 202*b*, a top 203, a bottom 204, and a perimeter 205. In one embodiment, perimeter 205 can comprise an edge portion around front 201 of top portion 102. In one embodiment, vents 108 can comprise a partial opening under sleeves 104. In one embodiment, vents 108 can comprise a first side vent 108*a* and a second side vent 108*b*. In one embodiment, first side vent 108*a* is under first sleeve 104*a* and second side vent 108*b* is under second sleeve 104*b*.

Figure 2B:
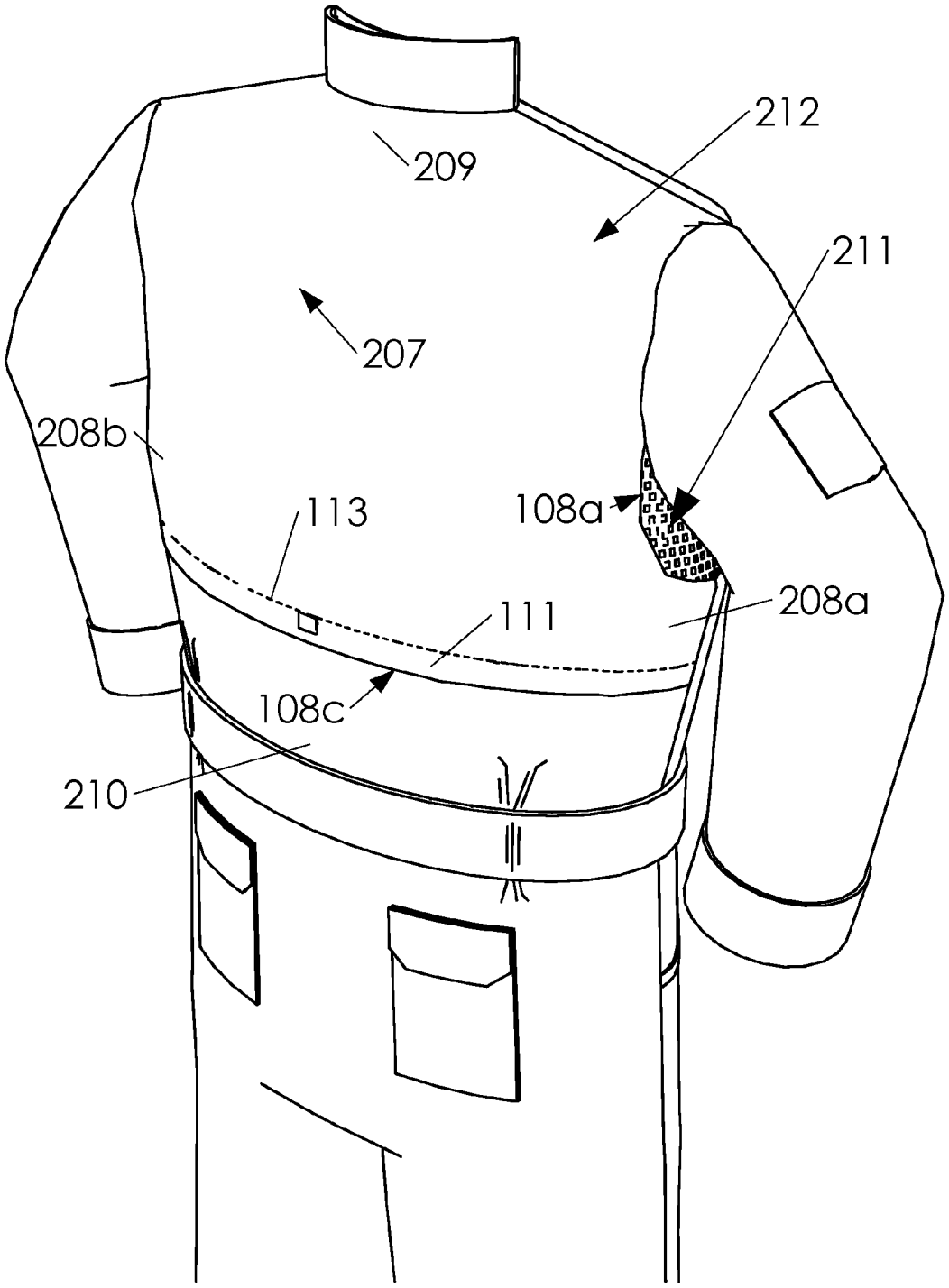
FIG. 2B illustrates a rear side overview of vented coveralls.

FIG. 2B illustrates a rear side overview of vented coveralls 100. Top portion 102 can comprise a back 207. Back 207 can comprise a first side 208*a*, a second side 208*b*, a top 209, and a bottom 210. In one embodiment, a portion of back 207 can comprise flap 111.

In one embodiment, top portion 102 can comprise a vented layer 211 and a cover layer 212. In one embodiment, cover layer 212 covers some portions of vented layer 211 and does not cover other portions of vented layer 211. In one embodiment, cover layer 212 does not cover a portion of vented layer 211 at first side vent 108*a* and second side vent 108*b*. In one embodiment, vented layer 211 can comprise a vented material capable of allowing an air flow (discussed infra) to pass through said top portion 102. Accordingly, in one embodiment, vents 108 can comprise portions of said vented material uncovered by cover layer 212. In one embodiment, first side vent 108*a* can be located on first side 112*a* of top portion 102 and under first sleeve 104*a*. In one embodiment, second side vent 108*b* can be located on second side 112*b* of top portion 102 and under second sleeve 104*b*.

In one embodiment, vents 108 can comprise replacing a portion of top portion 102 with said vented material by sewing said vented material into top portion 102. In such an embodiment, vents 108 would not be in vented layer 211; rather, vents 108 would be sewn into vented coveralls 100 where and would not necessarily underlay a cover layer 212 (except at flap 111).

Figure 3A:
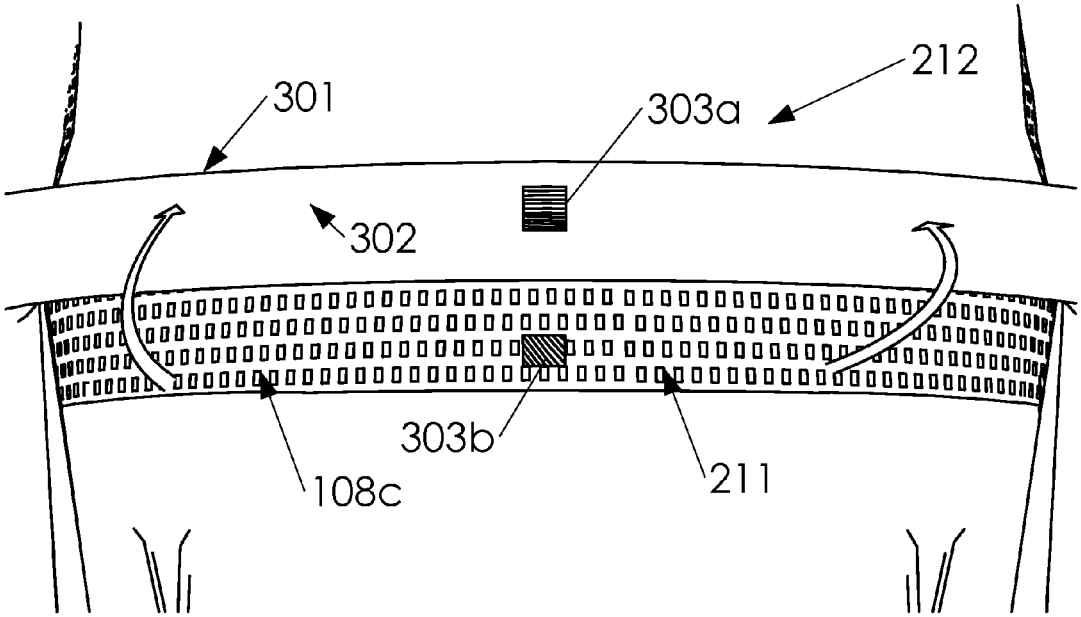
FIGS. 3A and 3B illustrate three views of cover layer with flap pulled up.
Figure 3B:
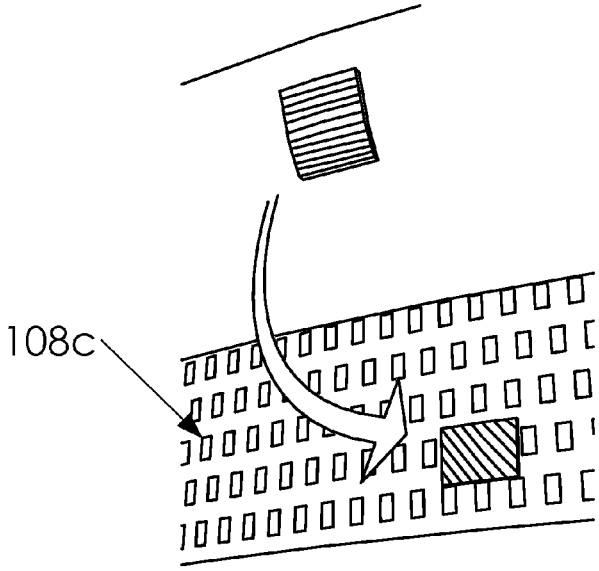

FIGS. 3A and 3B illustrate three views of cover layer 212 with flap 111 pulled up. In one embodiment, flap 111 can comprise a vent in back 207 comprising an opening between cover layer 212 and vented layer 211 between first side 208*a* and second side 208*b*. In one embodiment, flap 111 can comprise a topside 301 and a bottom side 302. In one embodiment, flap 111 can further comprise a hook-and-loop fasteners 303 having a first fastener 303*a* and a second fastener 303*b*. In one embodiment, first fastener 303*a* attaches to bottom side 302; second fastener 303*b* can attach to vented layer 211; and hook-and-loop fasteners 303 can releasably hold flap 111 to vented layer 211. In one embodiment, hook-and-loop fasteners 303 can releasably hold cover layer 212 to vented layer 211 at flap 111.

Figure 3C:
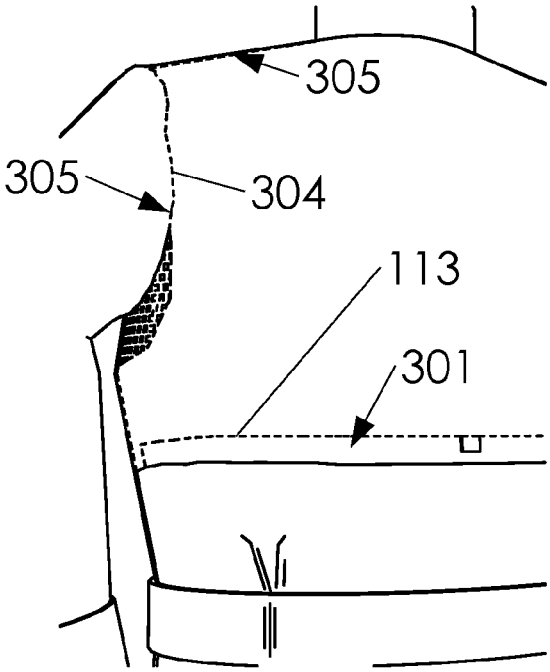
FIG. 3C illustrates flap stitch and a perimeter stitch holding cover layer to vented layer.

FIG. 3C illustrates flap stitch 113 and a perimeter stitch 304 holding cover layer 212 to vented layer 211. In one embodiment, cover layer 212 can attach to cover layer 212 with flap stitch 113 and perimeter stitch 304. In one embodiment, perimeter stitch 304 can comprise a stitch around a top and side portions of a perimeter 305 of cover layer 212. In one embodiment, flap 111 can comprise a portion of cover layer 212 below flap stitch 113; wherein, flap stitch 113 attaches a lower portion of cover layer 212 to a lower portion of vented layer 211.

Figure 4:
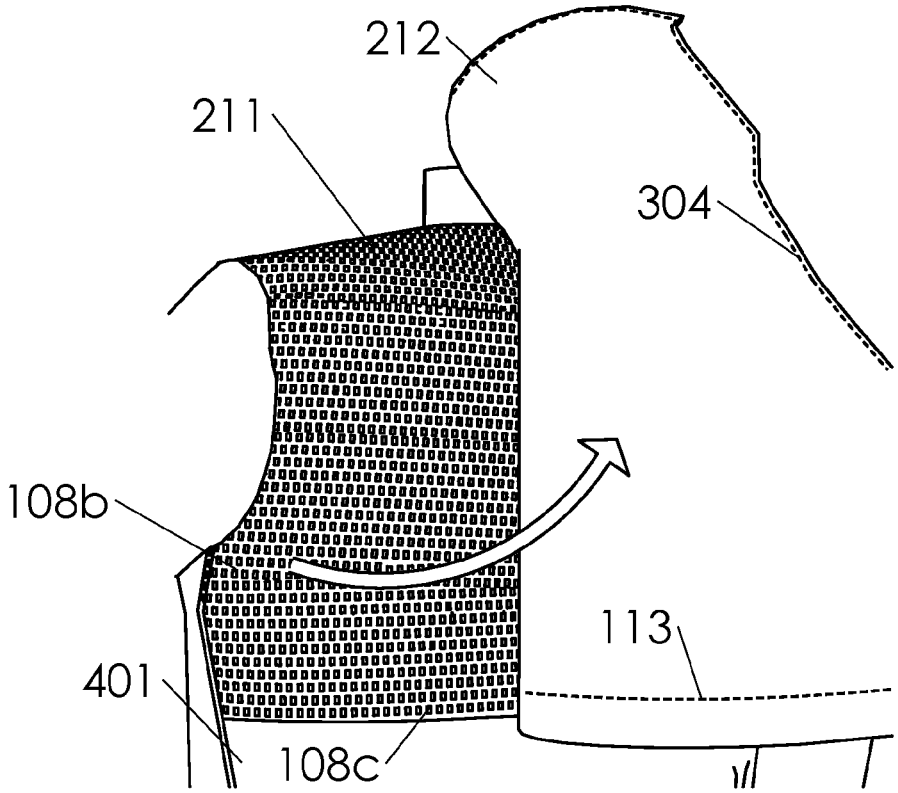
FIG. 4 illustrates a view of vented layer with cover layer peeled away.

FIG. 4 illustrates a view of vented layer 211 with cover layer 212 peeled away. In one embodiment, vented layer 211 can underlie cover layer 212. In one embodiment, if flap stitch 113 and perimeter stitch 304 were removed and hook-and-loop fasteners 303 were released, cover layer 212 would pull away from vented layer 211. In one embodiment, back 207 can comprise vented layer 211 attached to a lower panel 401 with cover layer 212 over a portion of vented layer 211. In one embodiment, lower panel 401 and cover layer 212 can comprise the same material. In one embodiment, where flap 111 is substantially closed and hook-and-loop fasteners 303 is attached, lower panel 401 and cover layer 212 can appear to be one panel.

Figure 5:
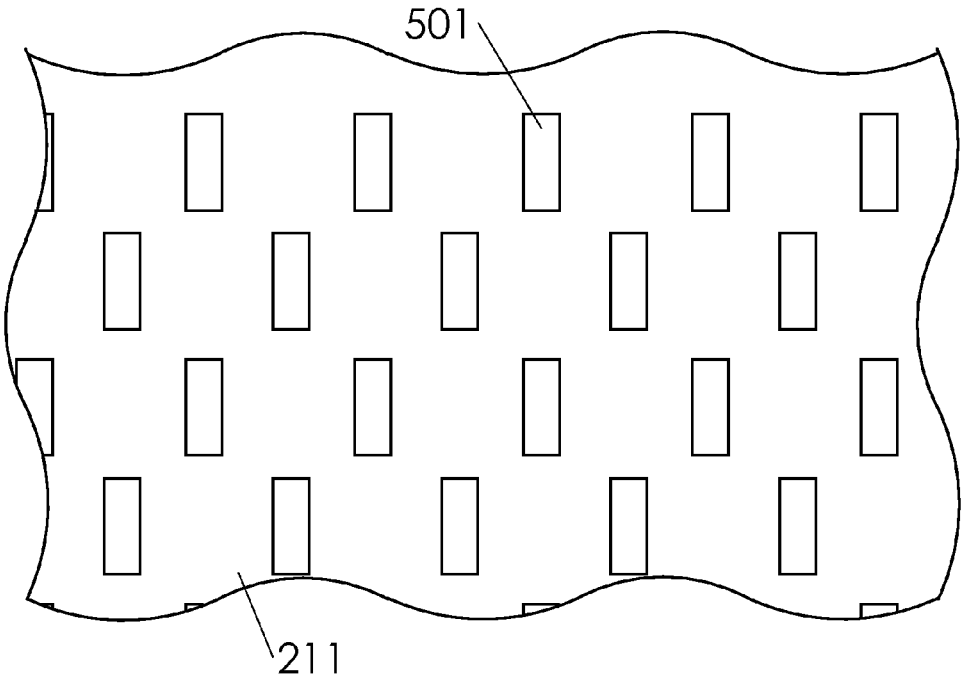
FIG. 5 illustrates a detailed view of vented layer.

FIG. 5 illustrates a detailed view of vented layer 211. In one embodiment, vented layer 211 can comprise a plurality of apertures 501. In one embodiment, apertures 501 are capable allowing airflow to pass through vented layer 211. In one embodiment, apertures 501 can comprise holes in vented layer 211. In one embodiment, apertures 501 can comprise substantially rectangular holes. In one embodiment, vented layer 211 can comprise a mesh of woven fibers; wherein, apertures 501 can comprise gaps between said woven fibers capable of allowing said airflow to pass through vented layer 211. In one embodiment, vented layer 211 can comprise said FR material. For example, in one embodiment, vented layer 211 can comprise woven strands of manufactured fireproof fibers.

Figure 6:
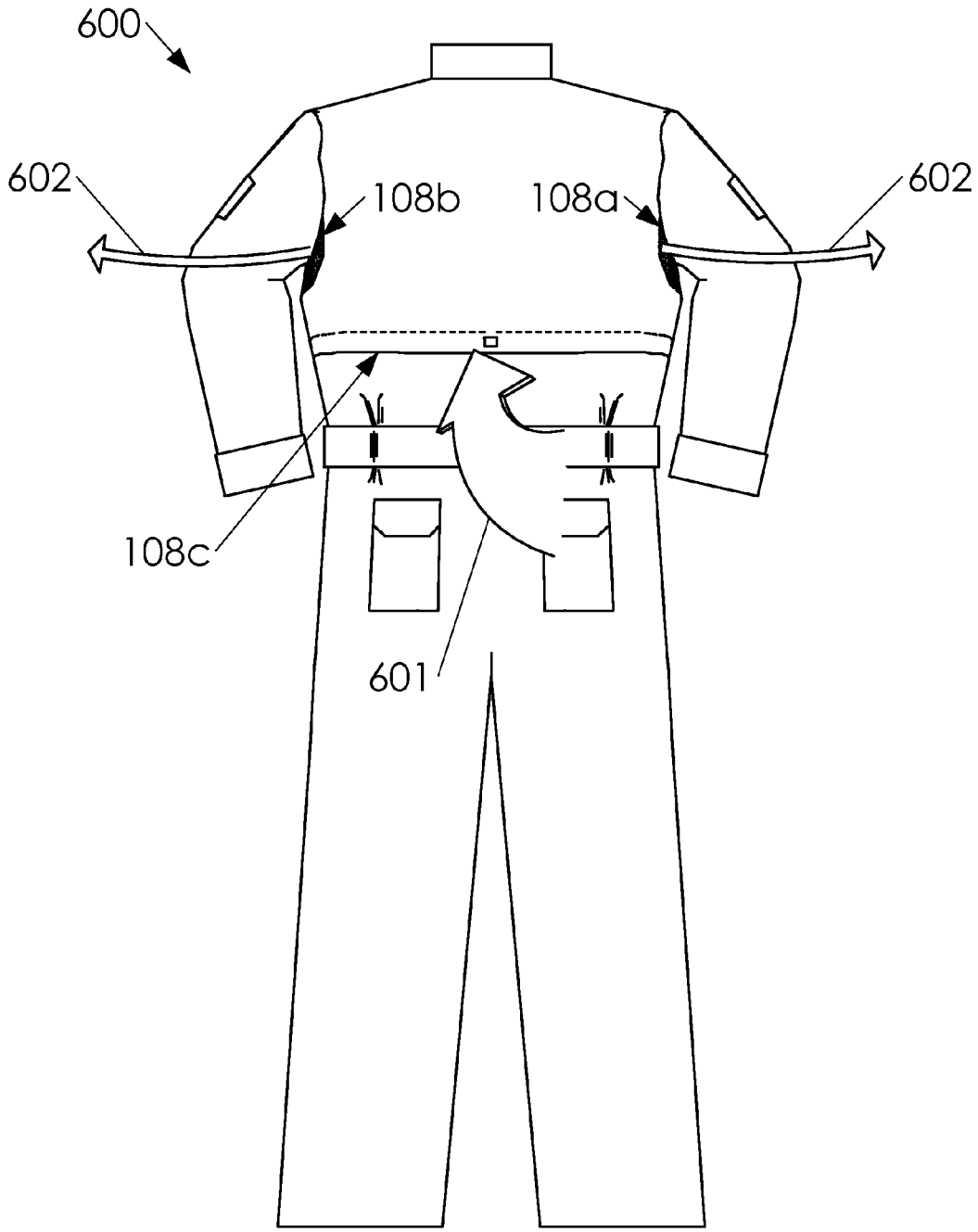
FIG. 6 illustrates an air ventilation system.

FIG. 6 illustrates an air ventilation system 600. Vented coveralls 100 can comprise air ventilation system 600. In one embodiment, air ventilation system 600 can comprise one or more air intakes 601 and one or more air out vents 602. In one embodiment, one or more among vents 108 can comprise air intakes 601 and one or more among vents 108 can comprise air out vents 602. Air ventilation system 600 can comprise a means of reducing heat stress on users of vented coveralls 100 and thereby improve health and comfort to users of vented coveralls 100. In one embodiment, by having a plurality of vents 108, vented coveralls 100 is capable of allowing for an air flow comprising air intakes 601 and air out vents 602 into and out of vented coveralls 100.

Figure 7A:
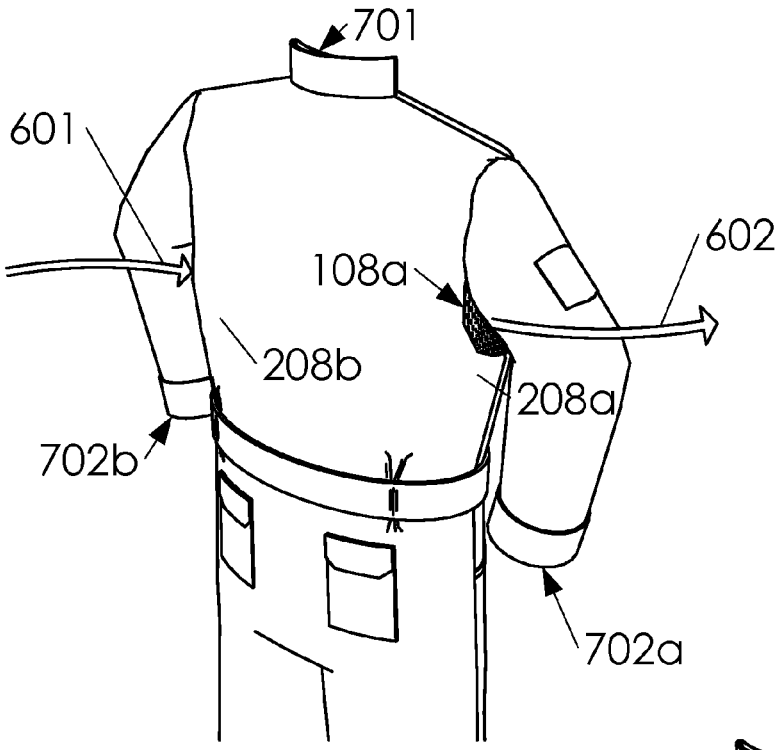
FIGS. 7A and 7B illustrate vented coveralls with various configurations of vents.
Figure 7B:
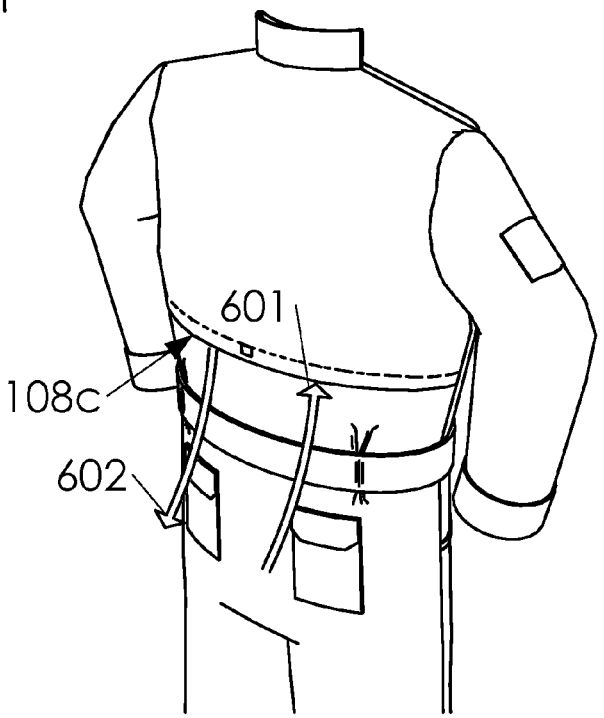

FIGS. 7A and 7B illustrate vented coveralls 100 with various configurations of vents 108. In one embodiment, vents 108 can comprise only first side vent 108*a* and second side vent 108*b*. In such an embodiment, one among first side vent 108*a* and second side vent 108*b* can comprise air intakes 601 and the other air out vents 602. In one embodiment, vents 108 can comprise only back vent 108*c*; wherein, back vent 108*c* comprises both air intakes 601 and air out vents 602. In one embodiment, vents 108 can comprise collar 701, cuffs 702, or other vents in vented coveralls 100 as will be apparent to parties experienced in the art.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A vented coveralls comprising:

a bottom portion comprising two legs;

a top portion comprising a front, a back, a first side, a second side, a first sleeve on the first side, a second sleeve on the second side, a vented layer, a cover layer, and a collar;

a waist being connected to the bottom portion and to the top portion, the waist being in between the bottom portion and the top portion;

the back of the top portion comprising a top of the back, a bottom of the back, and a flap, the flap being between the top of the back and the bottom of the back;

the top of the back comprising the cover layer and the vented layer, the cover layer overlaying the vented layer;

a first and second portion of the vented layer being uncovered by the cover layer and a remaining portion of the vented layer being covered by cover layer;

the cover layer comprising two or more vents;

the two or more vents comprising a first side vent, a second side vent, and a back vent;

the first side vent being directly adjacent to and bound by the cover layer and the first sleeve, the first side vent comprising the first uncovered portion of the vented layer located on the first side of the top portion and under the first sleeve;

the second side vent being directly adjacent to and bound by the cover layer and the second sleeve, the second side vent comprising the second uncovered portion of the vented layer located on the second side of the top portion and under the second sleeve;

the back vent being formed in the back of the top portion;

the two or more vents exposing the vented layer;

the vented layer being attached to the first and second sleeves and at the top of the back of the top portion;

the two or more vents being formed in the top portion;

the first and second side vents being located in between the collar and the back vent;

the back vent being located below both of the first and second side vents and in between the waist and the first and second side vents;

the first side vent being located in the first side of the top portion, and the second side vent being located in the second side of the top portion;

a portion of the vented coveralls comprising a fire resistant, flame resistant, fire retardant or flame retardant material;

the bottom portion comprising a trouser portion;

the top portion comprising a shirt portion;

the flap covering the back vent;

the flap comprising a portion of the cover layer below a flap stitch, the flap stitch attaching the cover layer to the vented layer;

the flap comprising a topside and a bottom side;

a hook-and-loop fastener;

the flap being releasably attached to the vented layer via the hook-and-loop fastener;

the hook-and-loop fastener comprising a first fastener and a second fastener; the first fastener being attached to the bottom side of the flap;

the second fastener being attached to the vented layer;

the two or more vents comprising an air ventilation system;

the air ventilation system comprising one or more air intakes and one or more air out vents;

the air intakes and the air out vents being formed by the back vent, the first side vent and the second side vent;

the vented layer comprising a mesh of woven fibers, the mesh having a plurality of apertures;

the vented material being sewn to the top portion;

the fire resistant, flame resistant, fire retardant or flame retardant material comprising a chemical treatment to inhibit the spread of fire to the vented coveralls; and the fire resistant, flame resistant, fire retardant or flame retardant material comprising a plurality of manufactured fireproof fibers capable of inhibiting the spread of fire.

* * * * *